US006937232B2

(12) United States Patent
Lin et al.

(10) Patent No.: US 6,937,232 B2
(45) Date of Patent: Aug. 30, 2005

(54) OVERDRIVE SYSTEM AND METHOD OF OPERATING OVERDRIVE SYSTEM

(75) Inventors: Wen-Tsung Lin, Tainan (TW); Yung-Yu Tsai, Kaohsiung (TW); Hsin-Ta Lee, Taoyuan (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 399 days.

(21) Appl. No.: 10/160,880

(22) Filed: May 31, 2002

(65) Prior Publication Data

US 2003/0137527 A1 Jul. 24, 2003

(30) Foreign Application Priority Data

Dec. 14, 2001 (TW) ..... 90131023

(51) Int. Cl.[7] ..... G09G 3/36; G09G 5/00

(52) U.S. Cl. ..... 345/204; 345/87; 345/541; 345/544; 345/545

(58) Field of Search ..... 345/87–89, 211, 345/212, 541–542, 543–547

(56) References Cited

U.S. PATENT DOCUMENTS 5,483,634 A * 1/1996 Hasegawa ..... 345/501
5,528,751 A * 6/1996 Priem et al. ..... 345/545
5,949,439 A * 9/1999 Ben-Yoseph et al. ..... 345/503
6,020,901 A * 2/2000 Lavelle et al. ..... 345/545
6,020,903 A * 2/2000 Jun ..... 345/541
6,043,829 A * 3/2000 Inoue ..... 345/519
6,364,770 B1 * 4/2002 Maruyama ..... 463/31

* cited by examiner

*Primary Examiner*—Regina Liang
*Assistant Examiner*—Duc Q Dinh
(74) *Attorney, Agent, or Firm*—J.C. Patents

(57) ABSTRACT

An overdrive system for driving a display device. A host machine includes a display interface for connecting with the display device. The display interface includes a display chip and a video memory. The overdrive system includes a frame buffer for holding the display data of the previous frame. The frame buffer uses a portion of the video memory space. The overdrive system also includes an overdrive look-up table coupled to the display chip to provide a correspondence between the overdrive display data, the display data of the previous frame and the display data of the present frame. The display chip retrieves overdrive display data from the overdrive look-up table according to the display data of the previous frame obtained from the frame buffer and the display data of the present frame and transmits the overdrive display data to the display device so that an image is formed on the display panel.

19 Claims, 5 Drawing Sheets

OVERDRIVE SYSTEM AND METHOD OF OPERATING OVERDRIVE SYSTEM

CROSS-REFERENCE TO RELATED APPLICATION

This application claims the priority benefit of Taiwan application serial no. 90131023, filed Dec. 14, 2001.

BACKGROUND OF THE INVENTION

1. Field of Invention

The present invention relates to an overdrive system and a method of operating the overdrive system of a display device. More particularly, the present invention relates to an overdrive system and a method of operating the overdrive system of a liquid crystal display (LCD) device.

2. Description of Related Art

A liquid crystal display (LCD) device applies electric field to drive liquid crystal molecules from an initial molecular alignment state to a different molecular alignment state. The change in molecular alignment brings about a change in optical property and visual appearance. In general, an LCD device may operate at a low operating voltage and consume very little electric power. Moreover, the LCD device can easily be driven by large scale integrated (LSI) circuits.

Intrinsic properties of liquid crystal molecules permit the application of an external electric field (a voltage) to re-orient their molecular alignment. Through selective alignment of molecules, the transparency of a liquid crystal pixels is changed to form an image pattern on the LCD. However, liquid crystal molecules have a relative slow response to electric field. For example, the application of a data voltage such as 5V to an image pixel may not rotate the liquid crystal molecules to a destined angle within a preset time period.

Slow response to data voltage compared with a conventional cathode ray tube (CRT) display means that blurred images may form when motion pictures are displayed. In other words, the transmission rate of image data to the LCD is so much faster than the response time of the LCD device that the liquid crystal molecules within the LCD device fail to follow well. To boost the response, some manufacturers have developed an overdrive circuit.

In general, to rotate liquid crystals molecules inside the pixel cell to a destined orientation at 5V within a preset time period, a data voltage higher than 5V needs to be applied. That is a larger data voltage applied to the pixel cell increases the rotation rate of the liquid crystal molecules. For example, to rotate liquid crystal molecules to an angular orientation $\theta_1$ that corresponds to the application of 5V within a preset time period T, a larger data voltage such as 6V is applied instead. Although the liquid crystal molecules are unable to rotate to an angular orientation $\theta_2$ ($\theta_2>\theta_1$) that corresponds to the application of a 6V within the time period T, the higher voltage permits the rotation of the liquid crystal molecules to an angle $\theta_1$ that corresponds to the application of 5V within the same time period T. The concept of designing an overdrive circuit is based on this fact.

To deploy the aforementioned type of overdrive circuit, the overdrive voltage must be computed based on a previous data frame. For example, if the previous state corresponds to a 0V data voltage and the next desired state is a 5V state, a higher data voltage such as 6V may be applied to a liquid crystal cell. However, if the previous state corresponds to a 5V data voltage and the next desired state is still a 5V state, an identical data voltage, in other words, 5V may be applied to the liquid crystal cell. On the other hand, if the previous state corresponds to a 3V data voltage and the next desired state is a 5V state, a moderately high data voltage such as 5.5V instead of a full 6V may be applied to the liquid crystal cell.

FIG. 1 is a block diagram showing the overdrive function of a conventional display device. A computer terminal 10 and a display terminal 20 are shown in FIG. 1. The display terminal 20 is a liquid crystal device (LCD) while the computer terminal 10 is controlled by an operating system 18. The computer terminal 10 communicates with the display terminal 20 via a display interface. Through the operating system, data to be displayed is transmitted to a display interface. The display interface re-transmits the data to the display terminal 20 and forms an image on a screen. The display interface further include a VGA BIOS 12, VGA chip 14 and video RAM (VRAM) 16.

The VGA chip 14 outputs image data to be displayed to a signal converter 21 of the display terminal 20. From the signal converter 21, the signals are transmitted to a timing controller 22. The timing controller 22 reads out the display data of the previous frame from a frame buffer 23. Accordingly, suitable overdrive display data is read out from a overdrive look-up table 24. The overdrive display data are transmitted to a driver 25 for driving a liquid crystal panel 26.

Although the aforementioned system is able to overdrive the LCD device, the display terminal 20 has a complicated structure and a high cost of production. If the frame buffer 23 has a resolution of about 1024 bits×768 bits, uses three primary color (RGB) and a 6-bit display, then the frame buffer 23 requires 1024×768×3×6 bits or about 1.73 MB. In other words, the display terminal 20 needs a memory having a memory capacity of at least 1.73 MB just to hold the frame data. In addition, the overdrive look-up table 24 needs a ROM having a memory capacity of at least 64×64×3 bytes for holding overdrive display data values and hence incurs additional production cost.

Furthermore, since additional leads are required to facilitate the communication and control between the frame buffer 23 and the timing controller 22, size of the timing controller 22 is increased.

SUMMARY OF THE INVENTION

Accordingly, a first object of the present invention is to provide an overdrive system and an operating method for the overdrive system that links a computer terminal to a display terminal. A frame buffer for holding overdrive display data of the overdrive system is installed inside the computer terminal so that the display terminal requires no addition internal memory.

A second object of this invention is to provide an overdrive system and an operating method of the overdrive system that links a computer terminal to a display device. An overdrive look-up table required by the overdrive system is selectively installed inside either the computer terminal or the display terminal so that overall complexity of connectivity within the display device is reduced and hence production cost of the display device is lowered.

To achieve these and other advantages and in accordance with the purpose of the invention, as embodied and broadly described herein, the invention provides an overdrive system for a display device. The overdrive system includes a host machine such as a personal computer having a display interface for connecting with the display device, a frame buffer and a display device. The display interface at least includes a VGA chip and a video memory unit mutually coupled together. The frame buffer holds the display data of the previous frame and uses a portion of the memory space within the video memory unit. The display device further includes a signal converter, a timing controller, a driver and a display panel. The signal converter is coupled to the VGA chip, the timing controller is coupled to the signal converter, the driver is coupled to the timing controller and the display panel is coupled to the driver. An overdrive look-up table is coupled to the VGA chip for retrieving overdrive display data according to the display data of a previous frame and the present frame. To operate the overdrive system, the display data of the previous frame is retrieved from the frame buffer so that the VGA chip is able to fetch a corresponding overdrive display data from the overdrive look-up table. Thereafter, the overdrive display data are sent to the display device and put up on the display panel.

The overdrive look-up table may be installed inside the display device or the host machine. In addition, the overdrive look-up table may be implemented using a read-only-memory (ROM), an electrically erasable programmable read-only-memory (EEPROM) or other storage devices having similar functions.

This invention also provides a second overdrive system for a display device. The second overdrive system includes a host machine such as a personal computer having a display interface for connecting with the display device, a frame buffer and a display device. The display interface at least includes a VGA chip and a video memory unit mutually coupled together. The frame buffer holds the display data of the previous frame and uses a portion of the memory space within the video memory unit. The display device further includes a signal converter, a timing controller, a driver and a display panel. The signal converter is coupled to the VGA chip, the timing controller is coupled to the signal converter, the driver is coupled to the timing controller and the display panel is coupled to the driver. An overdrive look-up table is coupled to the VGA chip for retrieving an overdrive display data according to the display data of a previous frame and a present frame. The host machine further includes an externally hooked device. The externally hooked device is coupled to the display card chip for providing an extrinsic program to the VGA chip. The extrinsic program provides a means of finding overdrive display data. To operate the overdrive system, the frame buffer provides the display data of the previous frame and the VGA chip fetches a corresponding overdrive display data from the extrinsic program. Thereafter, the overdrive display data are sent to the display device and put up on the display panel.

This invention also provides a method of operating an overdrive system to send image data from a host machine and display the data on a liquid crystal display screen. The host machine includes a display interface and a host memory unit. A portion of the space inside the host memory unit is reserved for holding frame buffer data. The method of operating the overdrive system includes initiating the overdrive look-up table and to read out the display data of a previous frame from the frame buffer. According to the display data of the previous frame and the present frame, overdrive display data is fetched from the overdrive look-up table. Finally, the overdrive display data is transmitted to the display device and displayed on the liquid crystal display panel. The overdrive look-up table may be installed inside the liquid crystal display terminal or the host machine terminal. Furthermore, the overdrive look-up table may be obtained from an extrinsic program.

According to this invention, the frame buffer is installed inside the computer terminal and hence no addition memory is required inside the display terminal. Since additional setup for channeling the communication between the timing controller and the memory is unnecessary, design complexity of the timing controller is greatly reduced. In addition, the overdrive look-up table may be selectively installed inside either the computer terminal or the display terminal. Ultimately, overall complexity and production cost of the display device is further reduced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
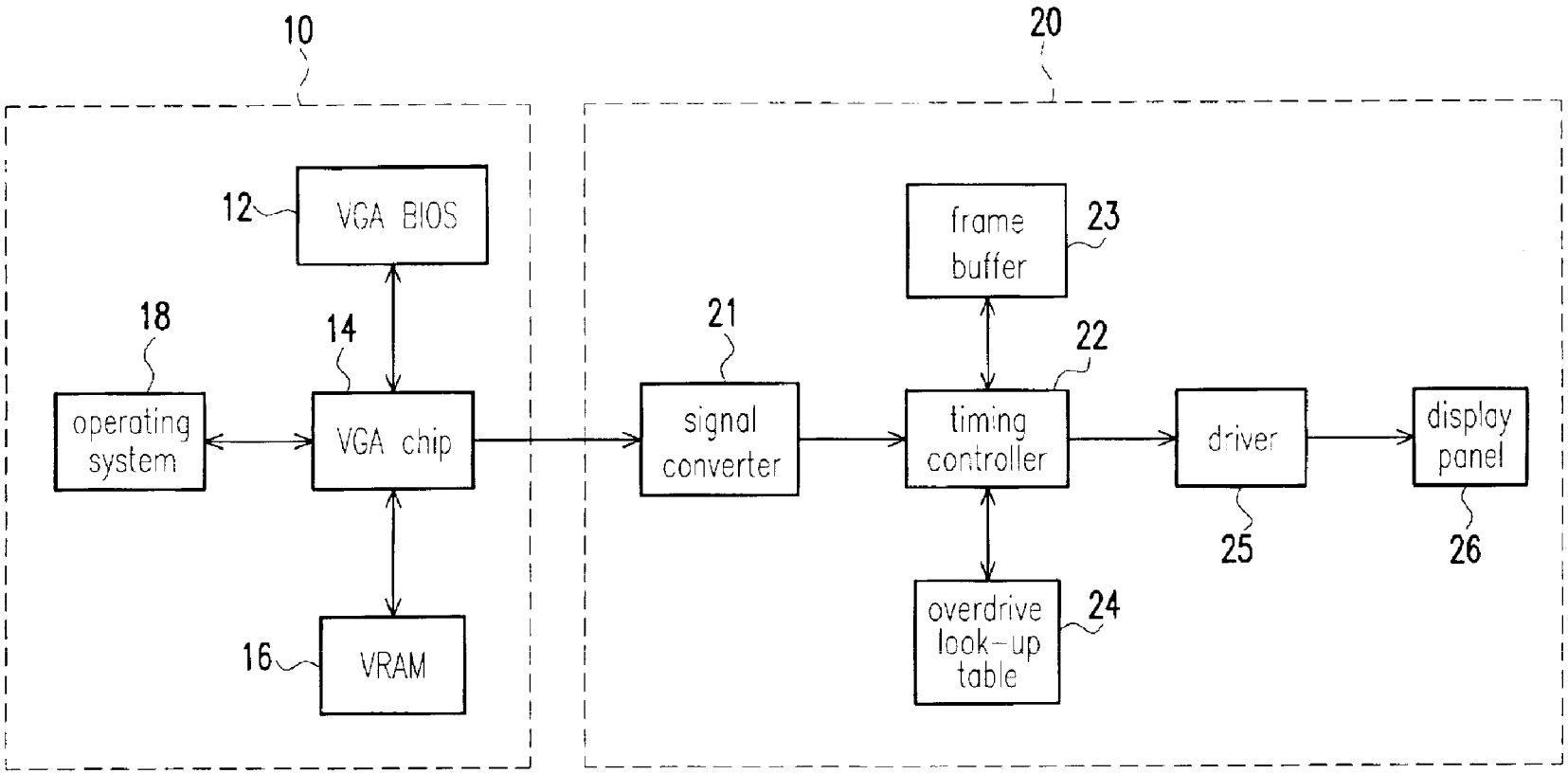
FIG. 1 (PRIOR ART)
FIG. 1 is a block diagram showing the overdrive function of a conventional display device.

Reference will now be made in detail to the embodiments of the invention, examples of which are illustrated in the accompanying drawings. Wherever possible, the same reference numbers are used in the drawings and the description to refer to the same or like parts.

The spirit of this invention is to move the frame buffer ordinarily installed inside a display device terminal to a device outside, in other words, a non-display terminal such as a host computer. In addition, the overdrive look-up table may be installed either within the display terminal or an outside device depending on the design criteria. With this rearrangement, connections within the display device are very much simplified so that the timing controller can be miniaturized and production cost can be reduced. A few embodiments are described below to serve as examples. However, these embodiments serve as illustrations only and should by no means limit the actual scope of this invention.

Figure 2:
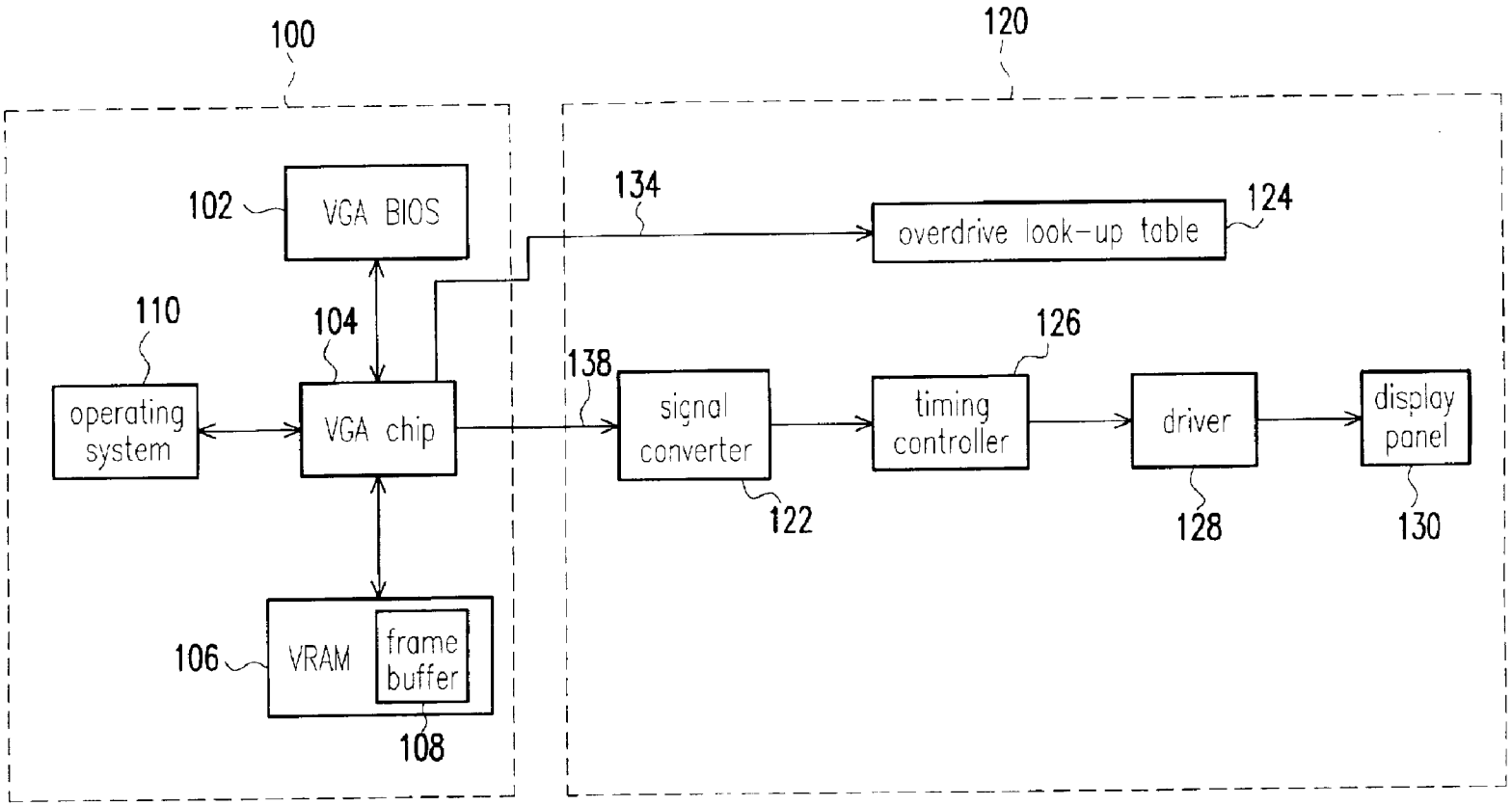
FIG. 2 is a block diagram showing an overdrive system for a display device according to a first embodiment of this invention.

FIG. 2 is a block diagram showing an overdrive system for a display device according to a first embodiment of this invention. As shown in FIG. 2, the overdrive system includes a computer terminal 100 and a display terminal 120. The display terminal 120 can be a liquid crystal display (LCD) and the computer terminal 100 is controlled by an operating system 110. The computer terminal 100 communicates with the display terminal 120 via a display interface. Image data are transmitted from the operating system 110 to the display terminal 120 through the display interface. Typically, the display interface has a plurality of subcomponents including a VGA BIOS 102, a VGA chip 104 and a video RAM (VRAM) 106.

In this embodiment, a frame buffer 108 is embedded within the VRAM 106 of the computer terminal 100. Due to the rapid progress in display card technologies and the demands for multi-media techniques, most VRAM 106 has a relatively large memory capacity up to 64 MB or higher. Since the frame buffer 108 needs just 1.7~3.9 MB of memory and only a portion of the VRAM 106 is actually in use, the frame buffer 108 takes up only a tiny fraction of the memory space of the VRAM 106. In other words, a portion of the memory space inside the VRAM 106 is set aside as a frame buffer for holding frame data.

The advantage of setting aside memory inside the VRAM 106 to serve as a frame buffer is that a communicative link between the display chip such as a VGA chip 104 and the VRAM 106 is already in existence. Hence, there is no need to set aside additional pins or to design special control modules. Once the computer terminal 100 is initiated, the VGA BIOS 102 starts an initialization operation to schedule functional capability of the VRAM 106. In other words, the frame buffer 108 is set up to perform any overdrive functions. Hence, after modifying the firmware of the VGA BIOS 102 within the computer terminal 100, the VGA chip 104 and the frame buffer 108 within the VRAM 106 may execute any overdrive functions.

Because the frame buffer 108 is established inside the VRAM 106 of the display interface, there is no need to install additional memory inside the display terminal to serve as frame buffer. Hence, the cost of providing for frame buffer memory inside the display terminal 120 is saved. Furthermore, without any frame buffer inside the display terminal 120, special control and signal transmission pins in the timing controller 126 are unnecessary. Therefore, overall pin count and design complexity of the timing controller 126 is reduced. Ultimately, manufacturing cost is further slashed.

The overdrive look-up table 124 as shown in FIG. 2 may be implemented using read-only-memory (ROM) units or electrically erasable programmable read-only-memory (EEPROM). Memory capacity of the look-up table 124, such as 64×64×3 bytes, may be adjusted according to the actual requirement. The overdrive look-up table 124 is installed inside the display terminal 120 according to the first embodiment. The overdrive look-up table 124 is connected to the VGA chip 104 inside the computer terminal 100 through a set of wires 134. Aside from the timing controller 126 and the overdrive look-up table 124, the display terminal 120 also includes devices connected similarly to the ones inside the display terminal 20 as shown in FIG. 1.

To operate the overdrive system in FIG. 2, the computer terminal 100 initializes the display interface. During initialization, the VGA BIOS is enabled to fetch an overdrive look-up table 124 from the display terminal 120 via the wires 134. When the computer terminal 100 needs to display data (text or pattern) on the display terminal 120, data is transferred to the VGA chip 104 through the operating system 110. Meanwhile, the VGA chip 104 also fetches the display data of a previous frame from the frame buffer 108 inside the VRAM 106. Overdrive display data are produced according to the display data of the previous frame and the the present frame.

The overdrive display data is transferred from the VGA chip 104 to the signal converter 122 inside the display terminal 120 via a set of wires 138. The timing controller 126 receives the overdrive display data from the signal converter 122 and transfers to the driver 128. The overdrive display data is converted in the driver 128 into the corresponding display voltages. And, accordingly, the display voltages drive the liquid crystal molecules inside the display panel 130 to display the image data.

The overdrive display data is fetched inside the computer terminal 100 through the VGA chip 104. After receiving the overdrive display data, the VGA chip 104 directs the data to the signal converter 122 inside the display terminal 120. On receiving the overdrive display data from the signal converter 122, the timing controller 126 inside the display terminal 120 sends the data to the driver 128. Unlike most conventional overdrive systems that require the timing controller to read out the display data of a previous frame and obtain corresponding overdrive display data, this invention employs a more direct approach.

Figure 3:
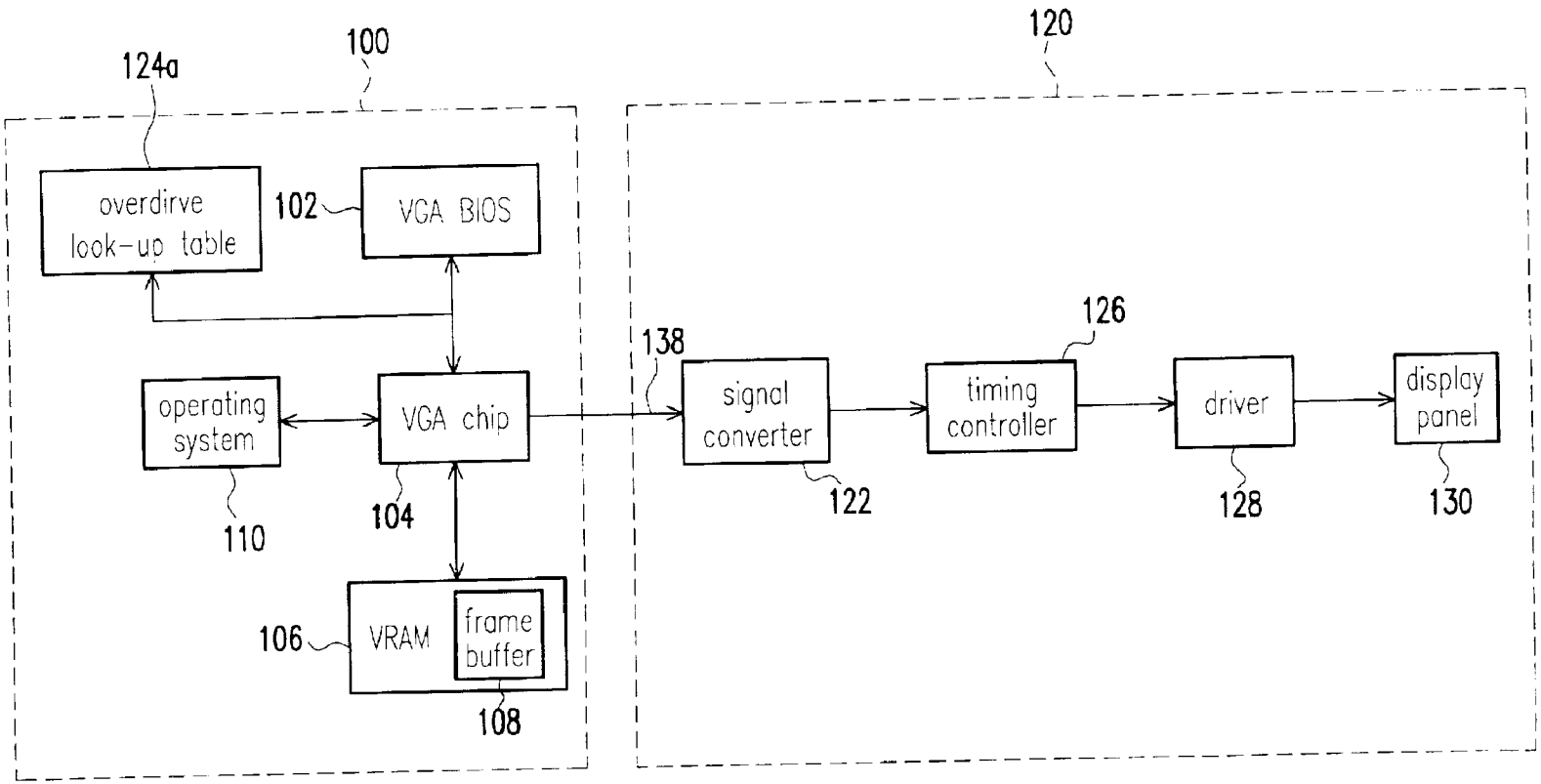
FIG. 3 is a block diagram showing an overdrive system for a display device according to a second embodiment of this invention.

FIG. 3 is a block diagram showing an overdrive system for a display device according to a second embodiment of this invention. The second embodiment is a variation of the first. One major difference from the first embodiment is that the overdrive look-up table 124*a* is installed inside the computer terminal 100 and connected to the VGA chip 104. The overdrive look-up table 124*a* can be 64×64×3 bytes read-only-memory (ROM) or other storage devices having a similar function. The actual memory capacity may be modified according to actual requirements. In addition, the overdrive look-up table 124*a* may be implemented by using the ROM units on the display interface.

The operating method is also quite similar to the first embodiment. After the VGA chip 104 has retrieved the display data of a previous frame from the frame buffer 108 inside the VRAM 106 and received the display data of a present frame from the operating system, corresponding overdrive display data is obtained from the overdrive look-up table 124*a* inside the computer terminal 100. The VGA chip 104 transmits the overdrive display data to the signal converter 122 inside the display terminal 120 via a set of wires 138. After receiving the overdrive display data from the signal converter 122, the timing controller 126 re-transmits the overdrive display data to the driver 128 to produce overdrive display voltage. Finally, the overdrive display voltage drives the liquid crystal molecules inside the display panel 130 to display image data.

In the second embodiment, since both the overdrive look-up table 124*a* and the frame buffer 108 are moved from the display terminal 120 to the computer terminal 100, all overdrive functions are established within the computer terminal 100. Hence, the display terminal 120 can be simplified to reduce production cost.

Furthermore, since different display devices may require different overdrive display data, a set of display identification code may be introduced in the display interface so that the display interface may recognize the type of display device connected to the computer terminal. Once the type of display device connected to the computer terminal is identified, a corresponding overdrive look-up table may be retrieved to generate suitable overdrive display data for the device.

Figure 4:
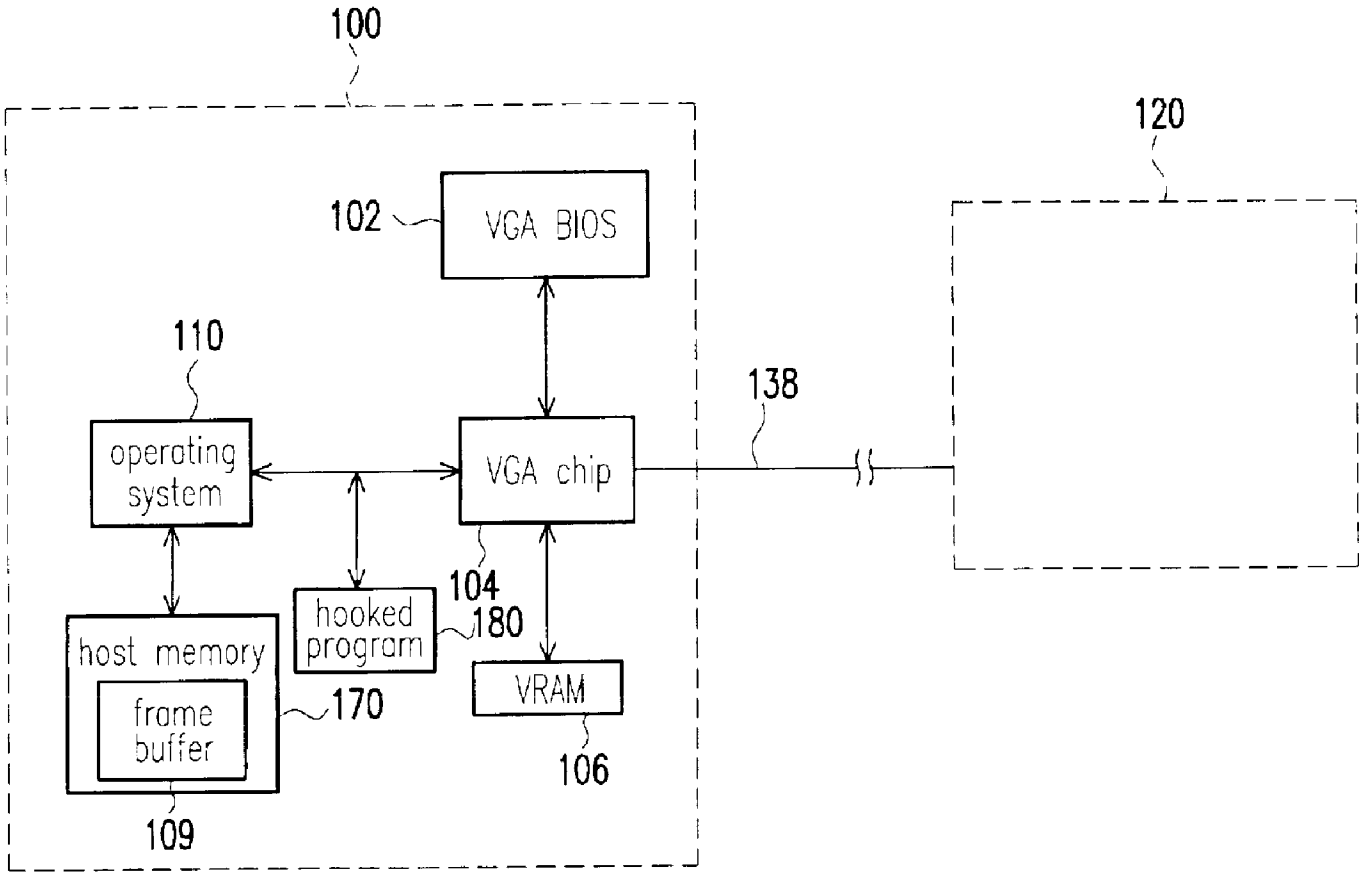
FIG. 4 is a block diagram showing an overdrive system for a display device according to a third embodiment of this invention.

FIG. 4 is a block diagram showing an overdrive system for a display device according to a third embodiment of this invention what the third embodiment differs from the first and the second embodiment is that the overdrive look-up table is installed neither inside the computer terminal 100 nor the display terminal 120. In addition, the frame buffer 109 may be installed either inside the VRAM 106 at the display interface or inside the host memory 170. An externally hooked program unit 180 is set up between the operating system 110 and the VGA chip 104. Overdrive display data is obtained through the externally hooked program unit 180. Since actual operation is identical to the second embodiment, detail explanation is not repeated here.

Since neither the computer terminal 100 nor the display terminal 120 has an overdrive look-up table, structural design of both the computer terminal 100 and the display terminal 120 can be simplified to reduce production cost. In addition, a set of display identification code may be introduced in the display interface so that the display interface may recognize the type of display device connected to the computer terminal similar to the second embodiment. Once the type of display device 120 connected to the computer terminal 100 is identified, a corresponding overdrive look-up table may be retrieved from the externally hooked program unit 180 to generate suitable overdrive display data for the device 120.

Aside from the aforementioned methods, display device manufacturers may also develop the overdrive system with operating system providers so that the operating system may provide the functions demanded from an overdrive look-up table. In other words, a corresponding overdrive look-up table may be automatically set once the operating system 110 is installed inside the computer terminal 100.

Figure 5:
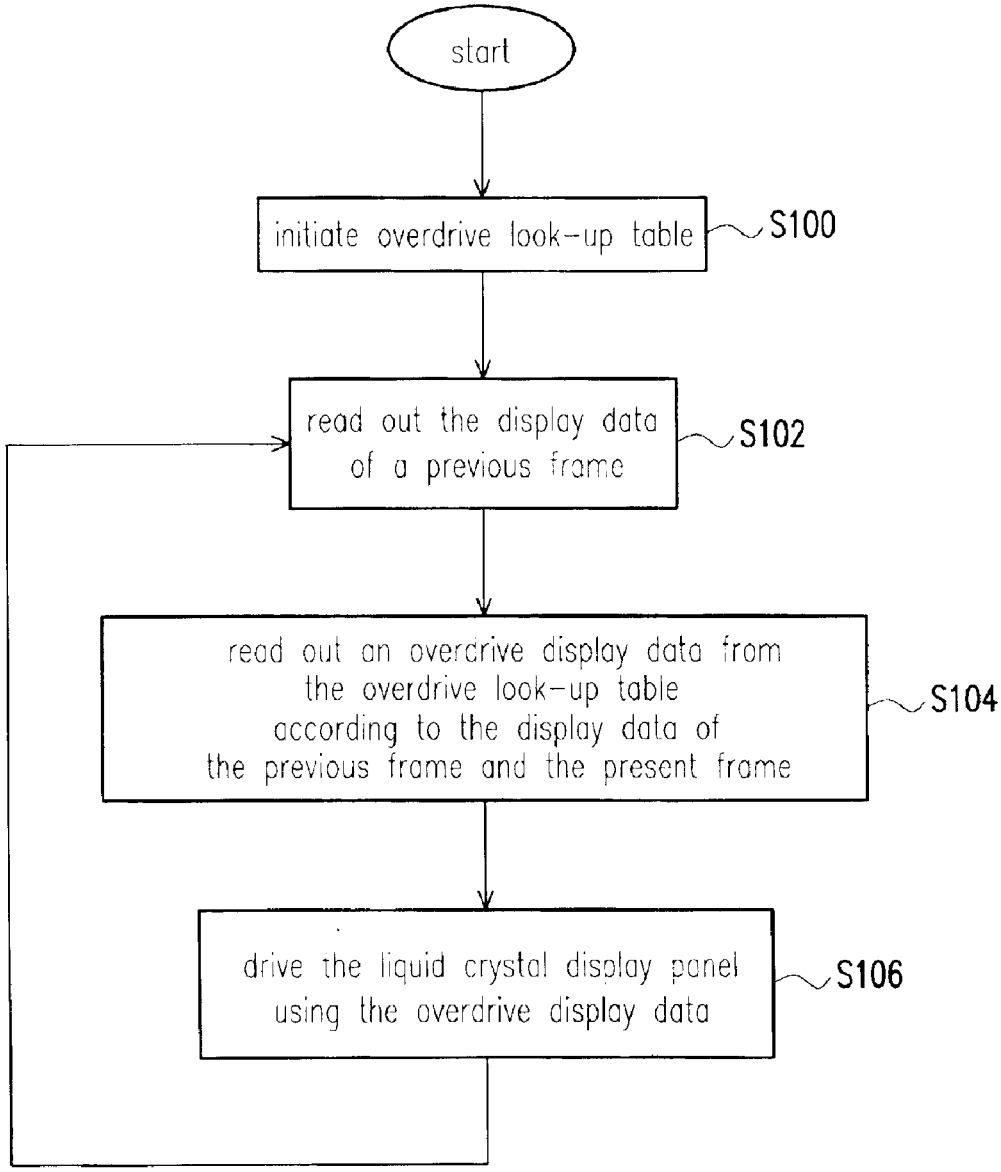
FIG. 5 is a flowchart showing the steps for operating the overdrive system of a display device according to this invention.

FIG. 5 is a flowchart showing the steps for operating the overdrive system of a display device according to this invention. The buffer frame is set up inside the computer terminal just like all the aforementioned embodiments. The overdrive look-up table is initiated in step S100 so that data within the overdrive look-up table may be retrieved from the ROM inside the display terminal or the ROM on the display card inside the computer terminal.

In step S102, display data of the previous frame is read out. According the method of this invention, the display data of the previous frame is read from the frame buffer. Suitable overdrive display data that correspond to the display data of the previous frame and the present frame are retrieved.

In step S104, according to the display data of the previous frame and the present frame to be displayed, correct overdrive display data is retrieved from the overdrive look-up table. Up to this stage, the fetching of previous frame display data and the inquiry for overdrive display data are carried out through devices such as a VGA chip inside the computer terminal.

Finally, in step S106, the overdrive display data is transmitted to the timing controller and driver inside the display terminal so that an overdrive display voltage drives the display panel and displays the image data on screen.

The overdrive system and operating method according to this invention not only uses an overdrive voltage to drive the liquid crystal display, but also reduces the complexity of driving circuits inside the display terminal and hence the production cost.

In summary, the first aspect of this invention is to install a frame buffer inside the computer terminal so that the display terminal requires no additional memory. Since the timing controller inside the display terminal does not need to communicate with frame buffer memory, design complexity of the timing controller is greatly reduced.

A second aspect of this invention is the selective placement of the overdrive look-up table inside the computer terminal or the display terminal. Hence, structure complexity and production cost of the display device may be reduced.

A third aspect of this invention is the possible introduction of a set of display device identification codes at the computer terminal. Hence, the type of display device connected to the computer terminal may be identified so that a set of suitable overdrive display data for the particular display device may be provided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An overdrive system for a liquid crystal display device, comprising:

a host machine having a display interface for connecting with a display device, wherein the display interface at least includes a display chip and a video memory mutually coupled together;

a frame buffer included in the video memory for holding a first display data, wherein the frame buffer uses a portion of the storage space inside the video memory;

a display device having a signal converter, a timing controller, a driver and a display panel, wherein the signal converter is coupled to the display chip, the timing controller is coupled to the signal converter, the driver is coupled to the timing controller and the display panel is coupled to the driver; and an overdrive look-up table coupled to the display chip;

wherein the display chip retrieves an overdrive display data from the overdrive look-up table according to the first display data from the frame buffer and a second display data of a present frame and transmits the overdrive display data to the display device.

2. The overdrive system of claim 1, wherein the overdrive look-up table is installed inside the display device.

3. The overdrive system of claim 1, wherein the overdrive look-up table is installed inside the host machine.

4. The overdrive system of claim 1, wherein the overdrive look-up table is implemented by using a read-only-memory (ROM).

5. The overdrive system of claim 1, wherein the overdrive look-up table is implemented by using an electrically erasable programmable read-only-memory (EEPROM).

6. The overdrive system of claim 1, wherein the timing controller is connected to the display chip through a first set of wires and the overdrive look-up table is connected to the display chip through a second set of wires.

7. The overdrive system of claim 1, wherein the display device includes a liquid crystal display device.

8. The overdrive system of claim 1, wherein the display card chip further uses a set of display device identification codes to identify the type of display device coupled to the host machine.

9. An overdrive system for a liquid crystal display device, comprising:

a host machine having a display interface for connecting with a display device, wherein the display interface at least includes a display chip and a video memory mutually coupled together;

a frame buffer installed inside the video memory for holding a first display data;

a display device having a signal converter, a timing controller, a driver and a display panel, wherein the signal converter is coupled to the display chip, the timing controller is coupled to the signal converter, the driver is coupled to the timing controller and the display panel is coupled to the driver; and an externally hooked device installed inside the host machine and coupled to the display chip providing an externally hooked program to the display chip;

wherein the display chip retrieves an overdrive display data from the externally hooked program according to the first display data from the frame buffer and a second display data of the present frame and transmits the overdrive display data to the display device.

10. The overdrive system of claim 9, wherein the display device includes a liquid crystal display device.

11. The overdrive system of claim 9, wherein the display chip further uses a set of display device identification codes to identify the type of display device coupled to the host machine.

12. The overdrive system of claim 9, wherein the frame buffer uses a portion of the storage space inside the video memory.

13. The overdrive system of claim 9, wherein the host machine further includes a host memory such that the frame buffer uses a portion of the storage space inside the host memory.

14. A method of operating an overdrive system to drive a liquid crystal display such that a display data issued by a host machine is displayed on the liquid crystal display screen, wherein the host machine includes a display interface having a video memory therein and a frame buffer included in the video memory, the method of operating the overdrive system comprising the steps of:

initiating an overdrive look-up table;

reading a first display data, wherein the first display data is stored inside the frame buffer;

retrieving an overdrive display data from the overdrive look-up table according to the first display data and a second display data of a present frame; and transmitting the overdrive display data to the display device to drive the display device.

15. The method of claim 14, wherein the overdrive look-up table is installed within the liquid crystal display terminal.

16. The method of claim 14, wherein the overdrive look-up table is installed within the host machine terminal.

17. The method of claim 14, wherein the overdrive look-up table is derived from an externally hooked program.

18. The method of claim 14, wherein the frame buffer uses a portion of the memory space inside the video memory.

19. The method of claim 14, wherein the host machine further includes a host memory and the frame buffer uses a portion of the memory space inside the host memory.

* * * * *